US008091881B2

(12) United States Patent
Nishimura

(10) Patent No.: US 8,091,881 B2
(45) Date of Patent: Jan. 10, 2012

(54) IMAGE FORMING APPARATUS

(75) Inventor: Michiaki Nishimura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 235 days.

(21) Appl. No.: 12/480,883

(22) Filed: Jun. 9, 2009

(65) Prior Publication Data

US 2010/0001451 A1 Jan. 7, 2010

(30) Foreign Application Priority Data

Jul. 3, 2008 (JP) ..... 2008-174593

(51) Int. Cl.
*B65H 37/04* (2006.01)

(52) U.S. Cl. ..... 270/58.09; 270/4; 270/20.1; 270/1.02; 270/21.1; 270/37; 270/58.07; 270/58.08; 399/410

(58) Field of Classification Search ..... 270/1.02, 270/4, 20.1, 21.1, 37, 52.17, 52.18, 58.07, 270/58.08, 58.09; 399/407, 408, 410
See application file for complete search history.

(56) References Cited

U.S. PATENT DOCUMENTS

| | | | | |
|---|---|---|---|---|
| 5,760,912 | A | 6/1998 | Itoh | |
| 6,599,226 | B2 | 7/2003 | Asai et al. | |
| 2002/0045524 | A1 * | 4/2002 | Asai et al. | 493/188 |
| 2009/0088308 | A1 * | 4/2009 | Obuchi et al. | 493/186 |

FOREIGN PATENT DOCUMENTS

| | | |
|---|---|---|
| JP | 8-172521 | 7/1996 |
| JP | 10-194574 | 7/1998 |
| JP | 2004-322342 | 4/2003 |
| JP | 2004-284750 | 10/2004 |

* cited by examiner

*Primary Examiner* — Leslie A Nicholson, III
(74) *Attorney, Agent, or Firm* — Renner, Otto, Boisselle & Sklar, LLP

(57) ABSTRACT

The image forming apparatus includes: an image processor; an image forming portion for forming images on recording paper based on the image data output from the image processor; a folding mechanism for folding the recording paper with images formed by the image forming portion when the input image information is confidential image information; and a stapling mechanism for binding the recording paper folded by the folding mechanism, at the end part when the input image information is confidential image information. When the input image information is confidential image information, the image processor outputs the pouch-binding image data for a pouch-bound image to be formed on the facing pages of the recording paper that is folded by the folding mechanism, by editing the layout of the confidential image.

5 Claims, 13 Drawing Sheets

IMAGE FORMING APPARATUS

This Nonprovisional application claims priority under 35 U.S.C. §119(a) on Patent Application No. 2008-174593 filed in Japan on 3 Jul. 2008, the entire contents of which are hereby incorporated by reference.

BACKGROUND OF THE INVENTION (1) Field of the Invention

The present invention relates to an image forming apparatus, in particular, relating to an image forming apparatus that is controlled to perform image output based on electrophotography.

(2) Description of the Prior Art

Recently, image forming apparatuses such as copiers, facsimile machines and the like, are configured to be able to easily perform image output by remote control from external devices such as PC terminals and the like. The documents output from the image forming apparatus can be usually stacked on the paper output tray and collected in a simple manner.

However, the documents on this paper output tray are exposed to the state in which any one can easily pick them up or any one can easily look the recorded content of the documents.

Under such circumstances, conventionally there has been a proposal of an image forming apparatus having the function of preventing illegal copy in order that an original copy and output copy will not be duplicated. For example, there is a disclosure of an image forming apparatus, in which, when confidential printing is designated, printing is carried out on the interior side of a recording sheet, and the recording sheet is saddle stitched by stapling so that the content printed on the interior side of the recording paper cannot be seen easily (see patent document 1: Japanese Patent Application Laid-open 2004-322342).

Though the conventional technology described above can prevent illegal copy by stapling confidential print sheets, it is still possible to grasp the content of the printed documents easily even when they remain being stapled. As a result, the above configuration still entails the problem that information leakage cannot be prevented.

SUMMARY OF THE INVENTION

The present invention has been devised in view of the above conventional problem, it is therefore an object of the present invention to provide an image forming apparatus which can prevent information leakage by making it difficult to look particular information that is recorded on the output paper from the image forming apparatus.

The image forming apparatus according to the present invention to solve the above problem is configured as follows:

The image forming apparatus according to the first aspect of the present invention, includes: an image processor for outputting input image information in the form of image data for forming images; an image forming portion for forming images on recording paper based on the image data output from the image processor; a folding mechanism for folding the recording paper with images formed by the image forming portion when the input image information is confidential image information; and, a stapling mechanism for binding the recording paper folded by the folding mechanism, at the end part when the input image information is confidential image information, and is characterized in that when the input image information is confidential image information, the image processor outputs the pouch-binding image data for a pouch-bound image to be formed on the facing pages of the recording paper that is folded by the folding mechanism, by editing the layout of the confidential image.

The second aspect of the present invention resides in that the pouch-bound image is given by swapping the positions of the left and right halves of the confidential image with respect to the fold.

The third aspect of the present invention resides in that the images to be disclosed on the facing pages of the folded recording paper by cutting open the folded recording paper along the fold complete the confidential image.

The fourth aspect of the present invention resides in that when the recording paper is to be stapled by the stapling mechanism, the image forming portion changes marginal areas where the pouch-bound image is not formed, in the recording paper, depending on the stapling position in the recording paper.

The fifth aspect of the present invention resides in that the image forming portion performs image forming so that the confidential image will be arranged in the suitable position in the recording paper when the folded recording paper is cut open along the fold.

The sixth aspect of the present invention resides in that the image forming portion has the function of allocating two pages of image information on a sheet of recording paper to be folded, or the function of forming an image in a so-called 2 in 1 layout, in which two pages of original images are formed on a sheet of paper at one step.

According to the first and second aspects of the present invention, since the image for pouch-binding that has been created by editing the layout of the confidential image is formed on the recording paper, it is possible to hide or obscure the confidential image, hence prevent leakage of confidential information, either in the state where the recording sheet is stapled or in the state where the sheet is left unstapled.

According to the third aspect of the present invention, it is possible to disclose confidential image information easily when needed.

According to the fourth aspect of the present invention, it is possible to arrange image information in the optimal position without having confidential image information bound up and hidden.

According to the fifth aspect of the present invention, it is possible to prevent part of confidential image information from being bound up and hidden.

According to the sixth aspect of the present invention, it is possible to allocate a plurality of pages sequentially.

DESCRIPTION OF THE PREFERRED EMBODIMENTS

The embodiment of the present invention will hereinafter be described in detail with reference to the accompanying drawings.

Figure 1:
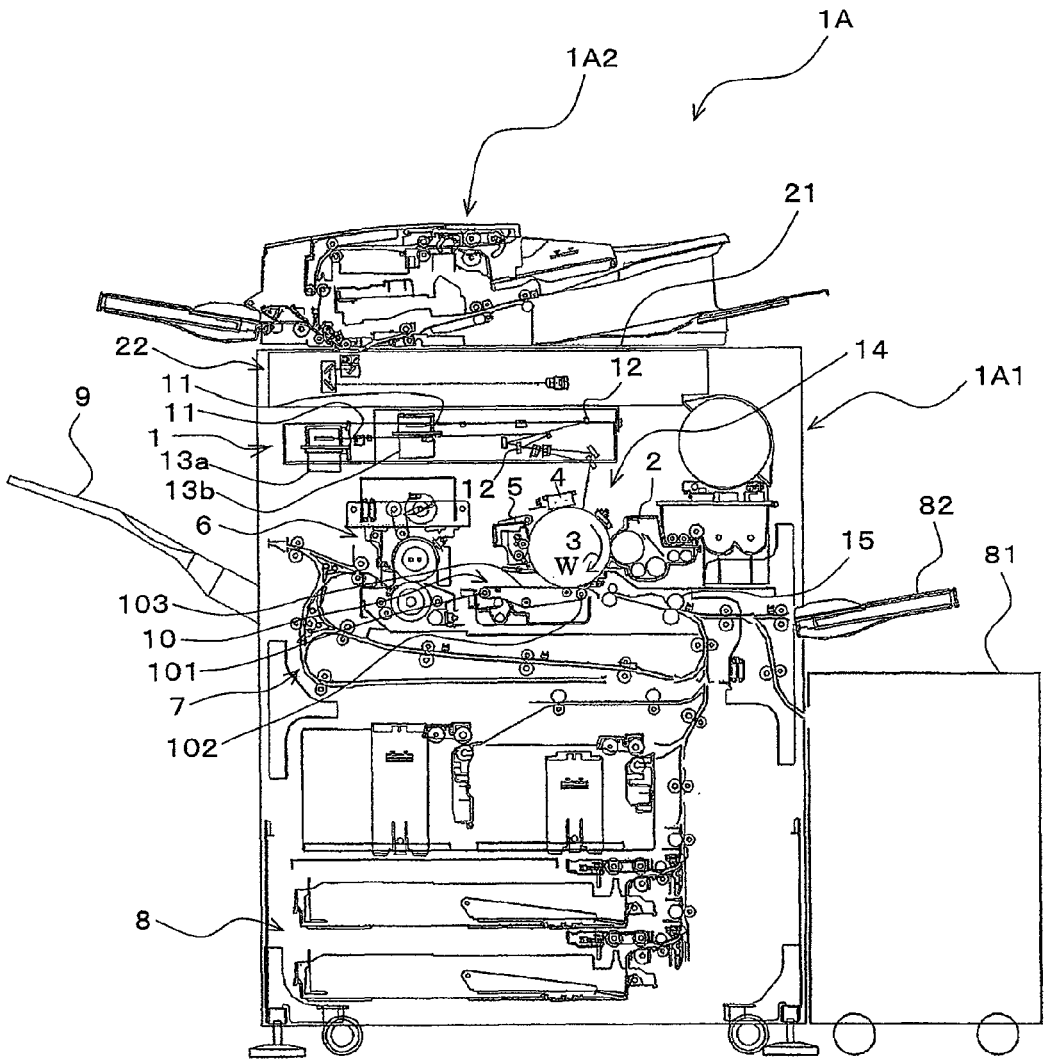
FIG. 1 is an illustrative view showing the overall configuration of an image forming apparatus according to the embodiment of the present invention.
Figure 2:
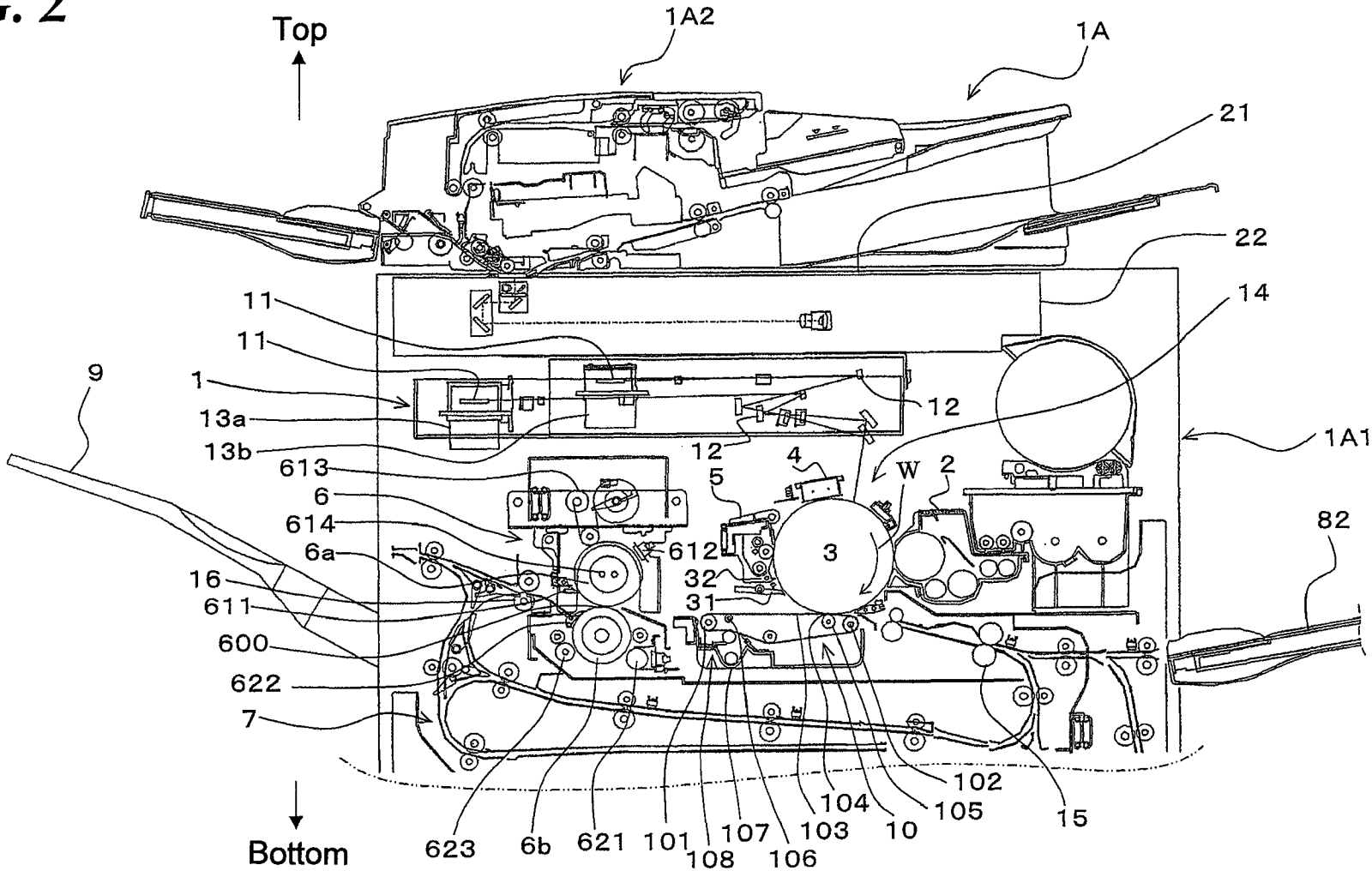
FIG. 2 is a partially detailed view showing the configuration of the apparatus body of the image forming apparatus.

FIG. 1 is an illustrative view showing the overall configuration of an image forming apparatus according to the embodiment of the present invention. FIG. 2 is a partially detailed view showing the configuration of the apparatus body of the same image forming apparatus.

To begin with, the overall configuration of an image forming apparatus 1A according to the present embodiment will be described with reference to the drawings.

Image forming apparatus 1A according to the present embodiment electrophotographically forms and outputs monochrome images of image data that was transferred from the outside, on predetermined sheet-like recording paper (to be referred to hereinbelow as paper) as recording media.

Image forming apparatus 1A is composed of, as shown in FIGS. 1 and 2, an apparatus body 1A1 and an automatic document processor 1A2.

The apparatus body 1A1 is essentially composed of a light exposure unit 1, a developing device 2, a photoreceptor drum 3, a charger 4, a cleaner unit 5, a fusing unit 6, a paper conveyor arrangement 7, a paper feed tray 8, a paper output tray 9, a transfer device 10 and the like.

Arranged on the top surface of apparatus body 1A1 is an original placement table 21 made of transparent glass on which a document is placed. Automatic document processor 1A2 is arranged on the top of this original placement table 21 so that it can pivotally open upwards while a scanner portion 22 as a document reader for reading image information of originals is laid out under this original placement table 21.

Arranged below scanner portion 22 are light exposure unit 1, developing device 2, photoreceptor drum 3, charger 4, cleaner unit 5, fusing unit 6, paper conveyor arrangement 7, paper output tray 9 and transfer device 10. Further, paper feed tray 8 that accommodates paper is arranged under these.

Light exposure unit 1 provides the function of emitting laser beam in accordance with the image data (printing image information) output from an unillustrated image processor to irradiate the photoreceptor drum 3 surface that has been uniformly charged by charger 4 so as to write and form an electrostatic latent image corresponding to the image data on the photoreceptor drum 3 surface. This light exposure unit 1 is arranged directly under scanner portion 22 and above photoreceptor drum 3, and includes laser scanning units (LSUs) 13*a* and 13*b* each having a laser emitter 11 and a reflection mirror 12. In the present embodiment, in order to achieve high-speed printing operation, a method for alleviating a rush of irradiation timings by using a multiple number of laser beams, namely a two-beam method, is adopted.

Here, in the present embodiment laser scanning units (LSUs) 13*a* and 13*b* are used for light exposure unit 1, but an array of light emitting elements, e.g., an EL or LED writing head may also be used.

As shown in FIG. 2, photoreceptor drum 3 has an approximately cylindrical shape, is arranged under light exposure unit 1 and is controlled so as to rotate in a predetermined direction (in the direction of arrow W in the drawing) by an unillustrated driver and controller. Arranged starting from the position at which image transfer ends downstream in the rotational direction of the photoreceptor drum along the peripheral surface of this photoreceptor drum 3 are a paper separation claw (recording medium separator) 31, cleaner unit 5, charger 4 as an electric field generator and developing unit 2 in the order mentioned.

Paper separation claw 31 is disposed so as to be moved into and out of contact with the outer peripheral surface of photoreceptor drum 3 by means of a solenoid (separator driver) 32. When this paper separation claw 31 is put in abutment with the outer peripheral surface of photoreceptor drum 3, it functions to peel off the paper, which has adhered to the photoreceptor drum 3 surface during the unfixed toner image on photoreceptor drum 3 being transferred to the paper. Here, as a drive means for paper separation claw 31, a drive motor may be used instead of solenoid 32, or any other driver may be also selected.

Developing unit 2 visualizes the electrostatic latent image formed on photoreceptor drum 3 with black toner, and is arranged at approximately the same level at the side (on the right side in the drawing) of photoreceptor drum 3 downstream of charger 4 with respect to the rotational direction of the photoreceptor drum (in the direction of arrow W in the drawing). A registration roller 15 is disposed under this developing unit 2 on the upstream side with respect to the recording medium feed direction.

Registration roller 15 is operated and controlled by an unillustrated driver and controller so as to convey the paper delivered from paper feed tray 8 into and between photoreceptor drum 3 and a transfer belt 103 whilst making the leading end of the paper register with the toner image on the photoreceptor drum 3.

Charger 4 is a charging device for uniformly charging the photoreceptor drum 3 surface at a predetermined potential, and is arranged over photoreceptor drum 3 and close to the outer peripheral surface thereof. Here, a discharge type charger 4 is used in the present embodiment, but a contact roller type or a brush type may be used instead.

Cleaner unit 5 removes and collects the toner left on the surface of photoreceptor drum 3 after development and image transfer, and is disposed at approximately the same level at the side of photoreceptor drum 3 (on the left side in the drawing), on the approximately opposite side across photoreceptor drum 3 from developing unit 2.

As described above, the visualized electrostatic image on photoreceptor drum 3 is transferred to the paper whilst the paper is being conveyed and applied from transfer device 10 with an electric field having an opposite polarity to that of the electric charge of the electrostatic image.

For example, when the electrostatic image bears negative (−) charge, the applied polarity of transfer device 10 should be positive (+).

As shown in FIG. 2, transfer device 10 is provided as a transfer belt unit form in which a transfer belt 103 having a predetermined resistivity (ranging from $1\times10^{9}$ to $1\times10^{13}$ Ω·cm in the embodiment) is wound and tensioned on a drive roller 101, a driven roller 102 and other rollers, and is disposed under photoreceptor drum 3 with the transfer belt 103 surface put in contact with part of the outer peripheral surface of photoreceptor drum 3. This transfer belt 103 conveys the paper while pressing it against photoreceptor drum 3.

An elastic conductive roller 105 having a conductivity different from that of drive roller 101 and driven roller 102 and capable of applying a transfer electric field is laid out at a contact point 104 where transfer belt 103 comes into contact with photoreceptor drum 3. Elastic conductive roller 105 is composed of a soft material such as elastic rubber, foamed resin etc. Since this elasticity of elastic conductive roller 105 permits photoreceptor drum 3 and transfer belt 103 to come into, not line contact, but area contact of a predetermined width (called a transfer nip) with each other, it is possible to improve the efficiency of transfer to the paper being conveyed.

Further, a charge erasing roller 106 for erasing the electric field that has been applied to the paper being conveyed through the transfer area so as to achieve smooth conveyance of the paper to the subsequent stage is disposed on the interior side of transfer belt 103, on the downstream side, with respect to the direction of paper conveyance, of the transfer area of transfer belt 103.

Transfer device 10 also includes a cleaning unit 107 for removing contamination due to leftover toner on transfer belt 103 and a plurality of charge erasing devices 108 for erasing electricity on transfer belt 103. Erasure of charge by erasing devices 108 may be performed by grounding via the apparatus or by positively applying charge of a polarity opposite to that of the transfer field.

The paper with the electrostatic image (unfixed toner) transferred thereon by transfer device 10 is conveyed to fusing unit 6, where it is pressed and heated so as to fuse and fix the unfixed toner to the paper. Fusing unit 6 includes a heat roller 6*a* and a pressing roller 6*b* as shown in FIG. 2 and fuses and fixes the toner image transferred on the paper by rotating heat roller 6*a* so as to convey the paper held between heat roller 6*a* and pressing roller 6*b* through the nip between heat roller 6*a* and pressing roller 6*b*. Arranged on the downstream side of fusing unit 6 with respect to the direction of paper conveyance is a conveyance roller 16 for conveying paper.

Heat roller 6*a* has a sheet separation claw 611, a roller surface temperature detector (thermistor) 612 and a roller surface cleaning member 613, all arranged on the outer periphery thereof, and also incorporates a heat source 614 for heating the heat roller surface at a predetermined temperature (set fixing temperature: approximately 160 to 200 deg. C.) in the interior part thereof.

Pressing roller 6*b* is provided at its each end with a pressing element 621 capable of abutting pressing roller 6*b* with a predetermined pressure against heat roller 6*a*. In addition a sheet separation claw 622 and a roller surface cleaning element 623 are provided on the outer periphery of pressing roller 6*b*, similarly to the outer periphery of heat roller 6*a*.

In this fusing unit 6, as shown in FIG. 2 the unfixed toner on the paper being conveyed is heated and fused by heat roller 6*a*, at the press-contact (so-called fusing nip portion) 600 between heat roller 6*a* and pressing roller 6*b*, so that the unfixed toner is fixed to the paper by its anchoring effect to the paper by the pressing force from heat roller 6*a* and pressing roller 6*b*.

Paper feed tray 8 stacks a plurality of sheets (paper) to which image information will be output (printed), and is arranged under image forming portion 14 made up of light exposure unit 1, developing unit 2, photoreceptor drum 3, charger 4, cleaner unit 5, fusing unit 6, etc. An unillustrated paper pickup roller is disposed over the paper delivery side of this paper feed tray 8.

This paper pickup roller picks up one sheet of paper at a time from the topmost of a stack of paper stored in paper feed tray 8, and conveys the paper downstream (for convenience' sake, the delivery side of paper (the cassette side) is referred to as upstream and the paper output side is referred to as downstream) to the registration roller (also called "idle roller") 15 side on paper conveyor arrangement 7.

Since the image forming apparatus 1A according to the present embodiment is aimed at performing high-speed printing tasks, a multiple number of paper feed trays 8 each capable of stacking 500 to 1500 sheets of standard-sized paper are arranged under image forming portion 14. Further, a large-capacity paper feed cassette 81 capable of storing multiple kinds of paper in large volumes is arranged at the flank of the apparatus. A manual feed tray 82 for essentially supporting printing etc. for irregular sized paper is arranged over the large-capacity paper feed cassette 81.

Paper output tray 9 is arranged on the opposite flank across the apparatus from that of manual feed tray 82. It is also possible to configure such a system that instead of paper output tray 9, a finisher for output paper (apparatus for stapling, punching and the like) and/or a multi-bin paper output tray etc., can be arranged optionally.

Paper conveyor arrangement 7 is laid out between the aforementioned photoreceptor drum 3 and paper feed tray 8, and conveys the paper supplied from paper feed tray 8, sheet by sheet, to transfer device 10, where a toner image is transferred from photoreceptor drum 3 to the paper. The paper conveyor arrangement further conveys the paper to fusing unit 6 where the unfixed toner image is fixed to the paper, then leads the paper as it is being guided by paper feed paths and branch guides, in accordance with the designated paper output processing mode.

Now, paper conveyor arrangement 7 will be described in detail with reference to the drawings.

Figure 3:
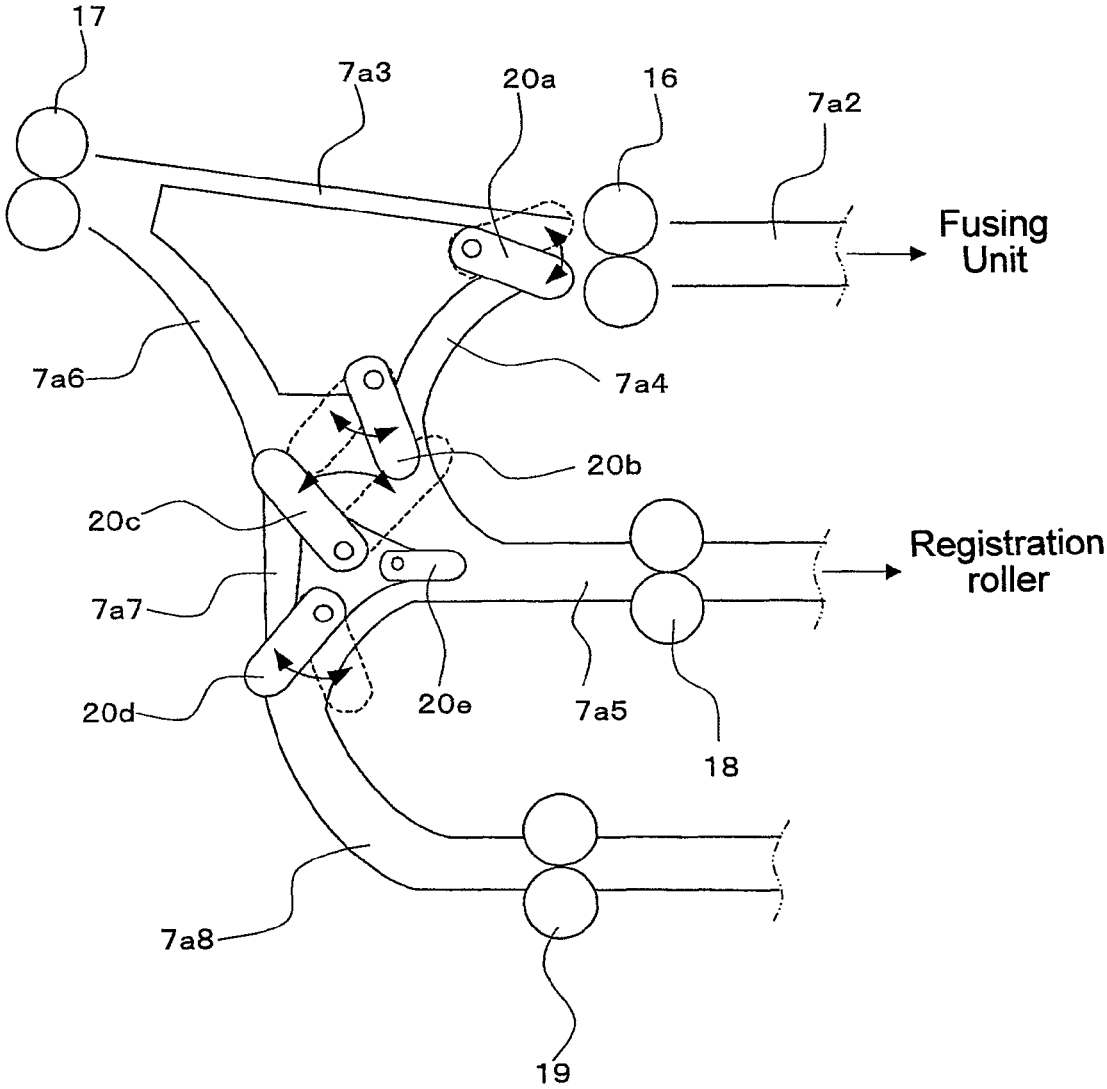
FIG. 3 is a partially detailed view showing the configuration of branched paper feed paths for the paper conveyor arrangement in the image forming apparatus and branch guides for connecting these paths.

FIG. 3 is a partially detailed view showing the configuration of branched paper feed paths for the paper conveyor arrangement in the image forming apparatus and branch guides for connecting these paths according to the present embodiment.

Paper conveyor arrangement 7 is essentially composed of a first paper feed path extending from paper feed tray 8 to registration roller 15, and second to eighth paper feed paths 7*a*2 to 7*a*8 shown in FIG. 3.

Second paper feed path 7*a*2 extends from registration roller 15 to a conveyance roller 16 on the downstream side, passing through transfer device 10 and fusing unit 6. Third paper feed path 7*a*3 extends from conveyance roller 16 to a paper discharge roller 17 for discharging paper to paper output tray 9. Fourth paper feed path 7*a*4 inverts paper P from conveyance roller 16. Fifth paper feed path 7a5 is connected to fourth paper feed path 7a4 and extends to an inversion conveyance roller 18 for re-feeding paper P to registration roller 15. Sixth paper feed path 7a6 conveys paper P in reverse from paper discharge roller 17. Seventh paper feed path 7a7 is connected to the sixth paper feed path to avoid entrance to fifth paper feed path 7a5. Eighth paper feed path 7a8 is connected to seventh paper feed path 7a7 and extends to a switchback roller 19.

Further, a plurality of branch guides for switching the route of paper conveyance by selecting the paper feed paths of paper P in accordance with the selected processing mode are arranged at branch points inside paper conveyor arrangement 7.

A branch guide 20a that selects connection to third paper feed path 7a3 or fourth paper feed path 7a4 is pivotably arranged at a point downstream of conveyance roller 16. This branch guide 20a is operated by an unillustrated solenoid.

A branch guide 20b is pivotably arranged on the downstream side of fourth paper feed path 7a4 so as to connect fourth paper feed path 7a4 with fifth paper feed path 7a5 or fifth paper feed path 7a5 with sixth paper feed path 7a6. This branch guide 20b is operated by the elastic force of an unillustrated spring member and the rigidity of paper P.

A branch guide 20c is pivotably arranged on the downstream side of sixth paper feed path 7a6 so as to select connection to fifth paper feed path 7a5 or seventh paper feed path 7a7. This branch guide 20c is operated by an unillustrated solenoid.

A branch guide 20d is pivotably arranged on the downstream side of seventh paper feed path 7a7 so as to connect seventh paper feed path 7a7 with eighth paper feed path 7a8 or fifth paper feed path 7a5 with eighth paper feed path 7a8. This branch guide 20d is operated by an unillustrated solenoid.

A branch guide 20e for assuring smooth connection from fourth paper feed path 7a4 or eighth paper feed path 7a8 to fifth paper feed path 7a5 is pivotably arranged on the upstream side of fifth paper feed path 7a5.

With the thus configured paper conveyor arrangement 7, branch guides 20a to 20e are operated in accordance with the requested processing mode, whereby it is possible to select a conveyance route of paper P corresponding to the selected processing mode.

Next, the paper conveyance operations corresponding to different processing modes of image forming apparatus 1A will be described with reference to the drawings.

Paper P that corresponds to a print request is selected from a multiple number of paper feed trays 8 and is conveyed by conveyance rollers in paper conveyor arrangement 7 to registration roller 15 (FIG. 2).

The paper P that has reached registration roller 15 and is temporarily suspended, is delivered to transfer device 10 by restarting rotation of registration roller 15 at such a timing as to make the leading end of paper P register with the image information on the photoreceptor drum 3, whereby the unfixed toner image (image information) is transferred from photoreceptor drum 3 to paper P, then the toner image is fixed to the paper P by fusing unit 6 and the paper is discharged to paper output tray 9.

With this paper conveyor arrangement 7, different conveyance routes are taken after fusing unit 6 up to paper output tray 9, depending on the functional modes (copy mode, printer mode, FAX mode) of image forming apparatus 1A and the print processing modes (one-sided printing, duplex printing).

In copier mode, the user usually operates the image forming apparatus 1A on site, so that the paper is generally adapted to be output "faceup", that is, the paper is discharged with its printed face up.

In contrast, in the printer and FAX modes, the user is not present near image forming apparatus 1A, so the paper is generally adapted to be output "facedown", that is, the sheets of paper P is discharged in the collated order.

Accordingly, image forming apparatus 1A is configured so that the paper P having passed through fusing unit 6 is conveyed along multiple conveyance paths through multiple branch guides and output to paper output tray 9 in the function-oriented manner.

(Faceup Output with One-Sided Printing)

In image forming apparatus 1A, in an output mode in which paper P is printed on its one side and discharged faceup, immediately before the paper P having passed through fusing unit 6 enters conveyance roller 16, branch guide 20a (FIG. 3) is actuated by an unillustrated guide position changeover means (solenoid etc.) to open third paper feed path 7a3 and close fourth paper feed path 7a4.

The paper P being conveyed advances with its leading part navigated by branch guide 20a, passing through third paper feed path 7a3 and is discharged by means of paper discharge roller 17 to paper output tray 9 (FIG. 2).

(Facedown Output with One-Sided Printing)

In image forming apparatus 1A, in an output mode in which paper P is printed on its one side and discharged facedown, immediately before the paper P having passed through fusing unit 6 enters conveyance roller 16, branch guide 20a (FIG. 3) is actuated by an unillustrated guide position changeover means (solenoid etc.) to open fourth paper feed path 7a4 and close third paper feed path 7a3. Further, branch guide 20c is actuated by an unillustrated guide position changeover means to open fifth paper feed path 7a5 and close seventh paper feed path 7a7.

The paper P being conveyed advances with its leading part navigated by branch guide 20a, passing through fourth paper feed path 7a4 and pushes away branch guide 20b by the rigidity (the strength of the material) of the leading end of paper P and conveyance force to open fifth paper feed path 7a5, then is navigated by branch guide 20c into fifth paper feed path 7a5.

When the rear end of paper P reaches the position of branch guide 20e, conveyance of paper P is temporarily suspended.

Branch guide 20c is actuated by an unillustrated guide position changeover means to open sixth paper feed path 7a6 and close seventh paper feed path 7a7. At this time, branch guide 20b moves by itself by an elastic member (spring etc.) disposed on an unillustrated branch guide support shaft and is set to close fourth paper feed path 7a4.

Then, inversion conveyance roller 18 rotates in reverse so as to restart conveyance of paper P. The paper P being conveyed advances with its rear end residing at the position of branch guide 20e first, passing through sixth paper feed path 7a6 and is output by way of paper discharge roller 17 to paper output tray 9.

(Output in Duplex Printing Mode)

When duplex printing is performed in image forming apparatus 1A, immediately before the paper P having the first print face (front side print) printed and passed through fusing unit 6 (FIG. 2) enters conveyance roller 16, branch guide 20a (FIG. 3) is actuated by an unillustrated guide position changeover means (solenoid etc.) to open fourth paper feed path 7a4 and close third paper feed path 7a3.

Further, branch guide 20c is actuated by an unillustrated guide position changeover means to open seventh paper feed path 7*a*7 and close fifth paper feed path 7*a*5. Branch guide 20*d* is also actuated by an unillustrated guide position changeover means to open eighth paper feed path 7*a*8.

The paper P being conveyed advances with its leading part navigated by branch guide 20*a*, passing through fourth paper feed path 7*a*4 and pushes away branch guide 20*b* by the rigidity (the strength of the material) of the leading end of paper P and conveyance force, then is navigated by branch guide 20*c* to be lead to seventh paper feed path 7*a*7 and further to eighth paper feed path 7*a*8.

When the rear end of paper P arrives at eighth paper feed path 7*a*8, conveyance of paper P is temporarily suspended (the completion of the first page switchback). Thereafter, as branch guide 20*d* is actuated by an unillustrated guide position changeover means to close seventh paper feed path 7*a*7 and open the conveyance path to branch guide 20*e*, switchback roller 19 rotates in reverse to restart conveyance of paper P.

The paper P being conveyed advances with its rear end that resides at the position in eighth paper feed path 7*a*8, first, passing through branch guide 20*e* and fifth paper feed path 7*a*5, and is conveyed to registration roller 15 (FIG. 5) which is located right before the printing stage (transfer step in the transfer device).

Thereafter, the second page printing of paper P (rear side printing) is performed. The paper P then passes through fusing unit 6 and is conveyed in the same manner as described in the above "Faceup output with one-sided printing" and discharged to paper output tray 9.

Next, the control system of image forming apparatus 1A characterizing the present embodiment will be described in detail with reference to FIG. 4.

Figure 4:
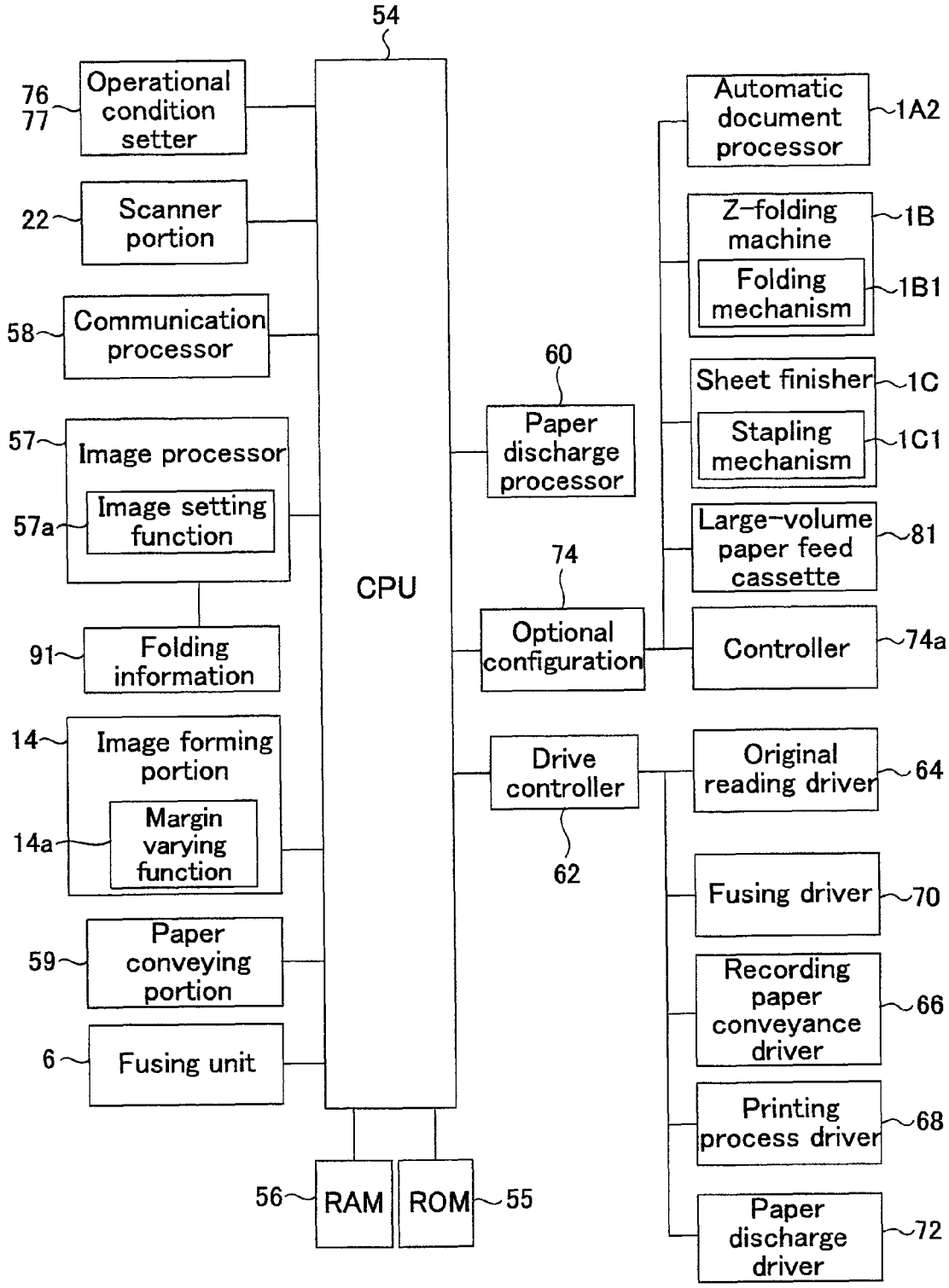
FIG. 4 is a block diagram showing an electric control configuration of the image forming apparatus.

FIG. 4 is a block diagram showing an electric controller configuration of the image forming apparatus according to the present embodiment.

As shown in FIG. 4, image forming apparatus 1A according to the embodiment executes processes such as image reading, image processing, image forming and conveyance of paper P, etc., by a central processing unit (CPU) 54 which performs control in accordance with the program stored beforehand in a ROM (read only memory) 55, using temporal storage such as a RAM (random access memory) 56 etc.

Here, it is also possible to use other storage devices such as HDDs (hard disk drives) etc., instead of ROM 55 and RAM 56.

In image forming apparatus 1A, the image information of an original (original image data) captured by scanner portion (original reading portion) 22, or original image information transmitted from other terminal devices connected on an unillustrated communication network, is input to an image processor 57 by way of a communication processor 58.

Image processor 57 shapes the original image information stored in the storage such as RAM 56 or the like into a printing image that is suited to printing (image forming onto recording paper), in accordance with the aforementioned program. The printing image information output from image processor 57 is input to image forming portion 14.

Image forming portion 14, paper conveying portion (performing various detentions and controls of the paper in paper conveyor arrangement 7 etc.), fusing unit 6 and paper discharge processor (performing various detentions and controls of the paper in paper discharge path 17) 60 are linked with respective components of drive controller 62.

Image forming apparatus 1A further has an operational condition setter 77.

This operational condition setter 77 sets up operational conditions for image forming and conditions of conveyance etc., in image forming apparatus 1A, in accordance with the image forming request and the image forming conditions such as the type of recording media (paper) etc., designated by the user through control switches 76.

Operational condition setter 77 can also set up operational conditions in accordance with the image forming conditions included in image output instructions (image data, control data) received by remote control from external devices such as PC terminals, facsimile machines etc.

Accordingly, confidential image printing instructions such as printing and copying of images having confidentiality (confidential images) may, either be directly input by the user through operational condition setter 77 of the image forming apparatus 1A or may be indirectly input by the user to another appliance instead of the image forming apparatus 1A, and the instructions may be transferred from the appliance to operational condition setter 77 of the image forming apparatus 1A.

In image forming apparatus 1A, based on the set operational conditions, drive controller 62 controls the drive actuators for the reading portion (scanner portion 22), paper conveying portion 59, image forming portion 14, fusing unit 6, paper discharge processor 60 etc., namely, an original reading driver 64, a recording paper conveyance driver 66, a printing process driver 68, a fusing driver 70 and a paper discharge driver 72. That is, driven controller 62 controls the above drivers so as to be operated in synchronization, following instructions from CPU 54 in accordance with the program stored in ROM 55.

Further, image forming apparatus 1A may be used with optional configurations 74 including a folding machine 1B, a finisher (stapler, puncher, multi-bin paper output trays, shifter, etc.) 1C, automatic document reader (automatic document processor 1A2 etc.), large-volume paper feed cassette 81 and the like. These optional configurations 74 incorporate individual controllers 74*a* separately from the controller of image forming apparatus 1A and are constructed so that each unit can operate in synchronization with the main apparatus by performing timing adjustment via the aforementioned communication processor 58.

Folding machine 1B includes a folding mechanism 1B1 for folding the paper in two or in three (so-called z-folding). Finisher 1C includes a stapling mechanism 1C1 for stapling the folded sheets along their side edge.

Image processor 57 has the image setting function which, when image data is printed on a pair of interior pages of a stapled pouch-bound sheet, creates image data for the interior pages of the pouch-bound sheet by editing a layout of image data to be shown, in advance, so that the images on the interior pages will be disclosed as desired when the pouch-bound sheet is cut open along the fold (on the side opposite the stapled side).

That is, image processor 57 has an image setting function 57*a* which, when pouch-bound sheet printing is designated, edits a layout by swapping the positions of the first and second images to be formed on, the first and second pages arranged inside when the sheet is folded, or the first and second pages facing each other when the sheet is folded, in accordance with folding information 91 for folding the image-formed sheet.

This folding information 91 may be set, for example, by input through control switches 76 in operational condition setter 77, or may be input from an external device. Specific examples of folding information may include folding information for folding the paper after image formation in two or in three (so called z-folding).

When receiving a command for confidential image printing, image forming apparatus 1A edits and rearranges the layout of the particular image information associated to that command into the image data for interior images and executes a printing operation for pouch-bound paper. At this time, since pages that are located inside when the paper is folded vary depending on the way in which the paper is folded, image processor 57 of the present embodiment sets up an image layout in accordance with the folding information on the paper so that among image information input to image processor 57, images based on the particular image information will be arranged on the interior side of the paper, and outputs the printing image information (image data) to image forming portion 14. Examples of particular image information associated to a confidential image printing command may include important information compared to usually formed images, information of confidentiality (confidential information) such as in-house information, inside information, personal information, etc.

As a result, in accordance with image processor 57 of the present embodiment, the image to be printed on the interior side of the pouch-bound paper has been subjected to the aforementioned layout edition, it is difficult to grasp the content of the confidential information from the pouch-bound interior image either when the paper is being pouch-bound or when the paper remains unstapled, hence it is possible to improve security. On the other hand, the user, who gave a confidential image printing command, may view the confidential information in a correct layout by cutting open the pouch-bound printout along the fold located opposite the side being stapled.

Image forming portion 14, in addition to the above-described function, has a function (margin varying function) 14*a* for varying the marginal areas where no image is formed in the folded paper P.

Next, the paper discharge process when folding machine 1B and finisher 1C are equipped to image forming apparatus 1A of the present embodiment will be described with reference to the drawings.

Figure 5:
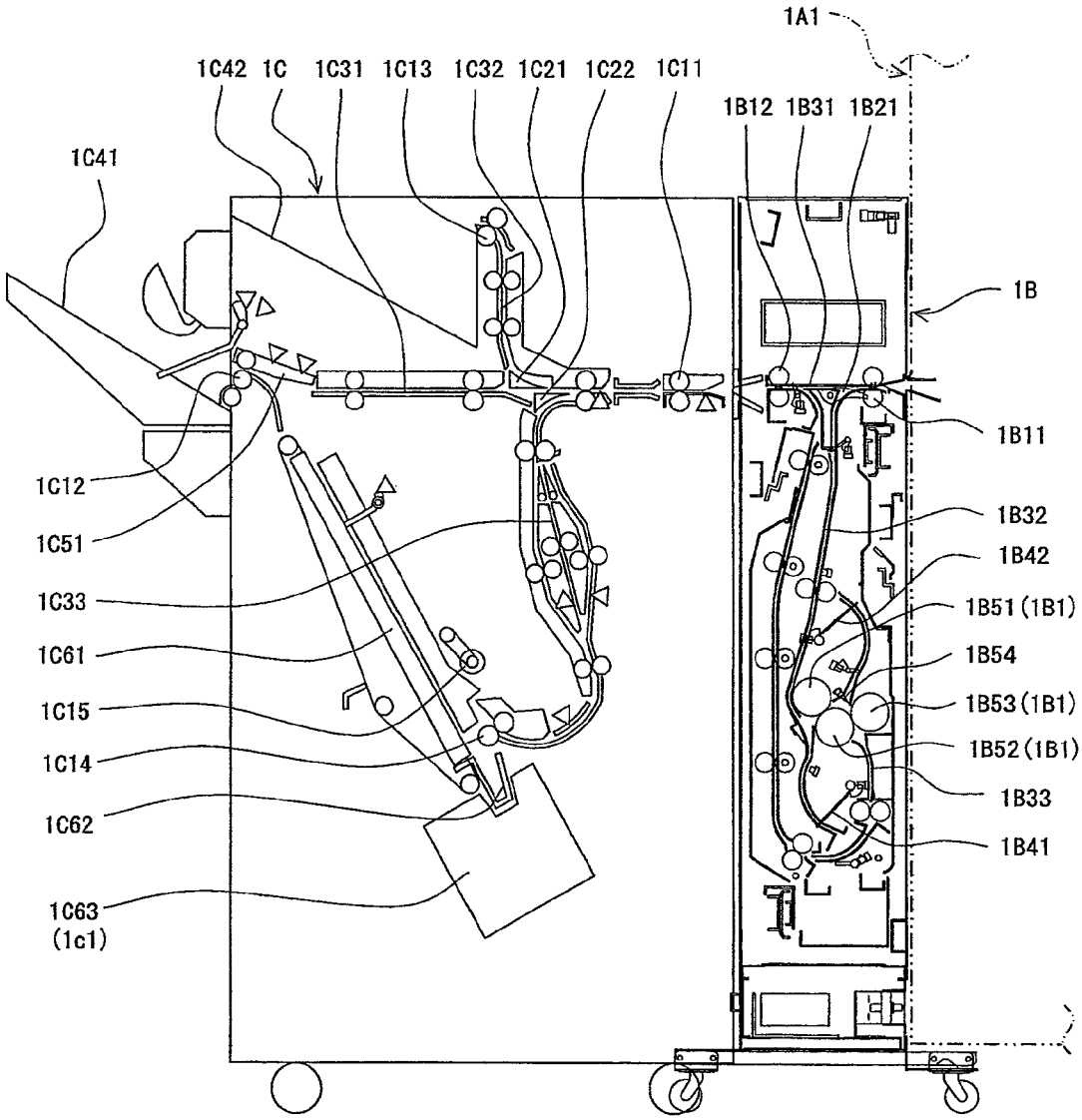
FIG. 5 is a schematic view showing the configuration of a folding machine and a finisher equipped to the image forming apparatus.

FIG. 5 is a schematic view showing the configuration of a folding machine and a finisher equipped to the image forming apparatus according to the present embodiment.

As shown in FIG. 5, folding machine 1B and finisher 1C are arranged on the flank (on the paper output side) of image forming apparatus 1A, folding machine 1B and finisher 1C being joined in series in this order from the upstream side with respect to the paper's direction of conveyance.

Folding machine 1B is a folding machine for folding the paper in two (for pouch-binding) and in three (so-called z-folding). Folding machine 1B leads the paper discharged from image forming apparatus 1A thereinto by means of an entrance roller 1B11 as shown in FIG. 5, and passes the paper therethrough without folding it or folds it thereinside, in accordance with the command from image forming apparatus 1A.

In folding machine 1B, when the command from image forming apparatus 1A does not indicate z-folding or pouch-binding either, a branch guide 1B21 is set by an unillustrated solenoid so that the paper is guided along a first feed path 1B31 and linearly discharged by discharge roller 1B12 out of folding machine 1B.

(Z-Folding)

When z-folding is selected by the command from image forming apparatus 1A, branch guide 1B21 is set so that the paper is guided toward a second feed path 1B32 having a z-folding arrangement for implementing z-folding of a sheet of paper and conveyed until the leading end of the paper abuts a first stopper 1B41. As a result, the paper is flexed in the middle of the paper with respect to the paper's direction of conveyance. The thus flexed middle portion is drawn by rotating first and second folding rollers 1B51 and 1B52 and guided into the nip between first and second folding rollers 1B51 and 1B52 to form a first fold in the paper.

Thereafter, similarly, the leading end of the folded paper abuts a second stopper 1B42, and the middle of the flexed part of the paper is guided toward the nip between second and third folding rollers 1B52 and 1B53 to from a second fold in the paper. That is, first to third folding rollers 1B51 to 1B53 constitute folding mechanism 1B1.

Then, the paper passes through a third feed path 1B33 located downstream of second and third folding rollers 1B52 and 1B53, is discharged out of folding machine 1B by discharge roller 1B12 and fed to the side of finisher 1C that is joined on the paper output side.

(Pouch-Binding)

When pouch-binding is selected by the command from image forming apparatus 1A, similarly to the Z-folding case branch guide 1B21 is switched for every sheet that is to be pouch-bound so that the paper is guided to second feed path 1B32 in order subject it to a pouch-binding process (two-folding process) and the leading end of the paper abuts first stopper 1B41. At this time, the position of abutment, or the position of first stopper 1B41 is shifted and adjusted so that the center of the paper to be folded, with respect to the paper's direction of conveyance, is correctly lead to first and second folding rollers 1B51 and 1B52. As a result, the paper is flexed in the center of the paper with respect to the paper's direction of conveyance, and the thus flexed center is guided into the nip between first and second folding rollers 1B51 and 1B52 to form a first fold in the paper.

The paper discharged from the folding rollers advances with its fold first. A gate 1B54 for changing the direction of conveyance is provided at the output side of first and second folding rollers 1B51 and 1B52 so that the aforementioned fold at the leading end is guided to the nip between second and third folding rollers 1B52 and 1B53. The fold guided by this gate 1B54 advances downstream from the nip between second and third folding rollers 1B52 and 1B53, passing through third feed path 1B33, and is discharged out of folding machine 1B by discharge roller 1B12 and fed to finisher 1C that is joined on the paper output side. Since the paper is conveyed as above, the folded paper advances with its fold first while the rear end is positioned on the binding side. Accordingly, when the paper is stapled at stapling mechanism 1C1 located downstream, a pouch can be created.

Finisher 1C guides the paper discharged from folding machine 1B thereinto by means of an entrance roller 1C11, and passes the paper therethrough without processing the paper or performs a stapling process for binding sheets of paper by means of staples therein, by the command from image forming apparatus 1A.

In finisher 1C, when non-staple mode is selected by the command from image forming apparatus 1A, the paper is introduced into the machine by entrance roller 1C11 so as to pass through branch guides 1C21 and 1C22 (normally, branch guides 1C21 and 1C22 are positioned along the direction of a non-staple feed path 1C31) and is discharged by a paper discharge roller 1C12 and stacked onto a vertically movable paper output tray 1C41. At this time, a paper output guide plate 1C51 is being closed.

When cut-in tray output mode is selected at the control portion of image forming apparatus 1A, branch guide 1C21 rotates by a predetermined angle so that the paper is conveyed to a cut-in tray feed path 1C32 and discharged by a paper discharge roller 1C13 and stacked onto a cut-in tray 1C42.

When staple mode is selected at the control portion of image forming apparatus 1A, branch guide 1C22 is actuated so that the paper is fed into a staple feed path 1C33, and further discharged by staple tray discharge roller 1C14 and stacked onto a staple tray 1C61.

The paper discharged on staple tray 1C61 is tapped downward, sheet by sheet, by a tapping roll 1C15 so that the rear end of the paper is abutted on a paper rear end reference fence 1C62 and aligned.

The sheets thus aligned are bound at one or two predetermined places at the rear end of the sheaf of paper by an end face binding stapler 1C63 of stapling mechanism 1C1. The thus bound sheaf of paper is raised up to paper discharge roller 1C12 by discharge claws (not illustrated) integrated with a discharge belt (not illustrated). The sheaf is then pressed against paper discharge roller 1C12 by paper output guide plate 1C51, and discharged by this paper discharge roller 1C12 and stacked on paper output tray 1C41.

Paper output tray 1C41 is arranged so as to be movable up and down by an unillustrated driver, and can be moved up and down in accordance with the stacked amount of discharged paper so that the paper to be discharged is discharged at the optimal position.

Next, the aforementioned layout editing process to be performed when a confidential image printing command is given will be described with reference to the drawings.

To begin with, a case in which image forming apparatus 1A performs image output following a middle folding (pouch-binding) command of paper P will be described.

Figure 6:
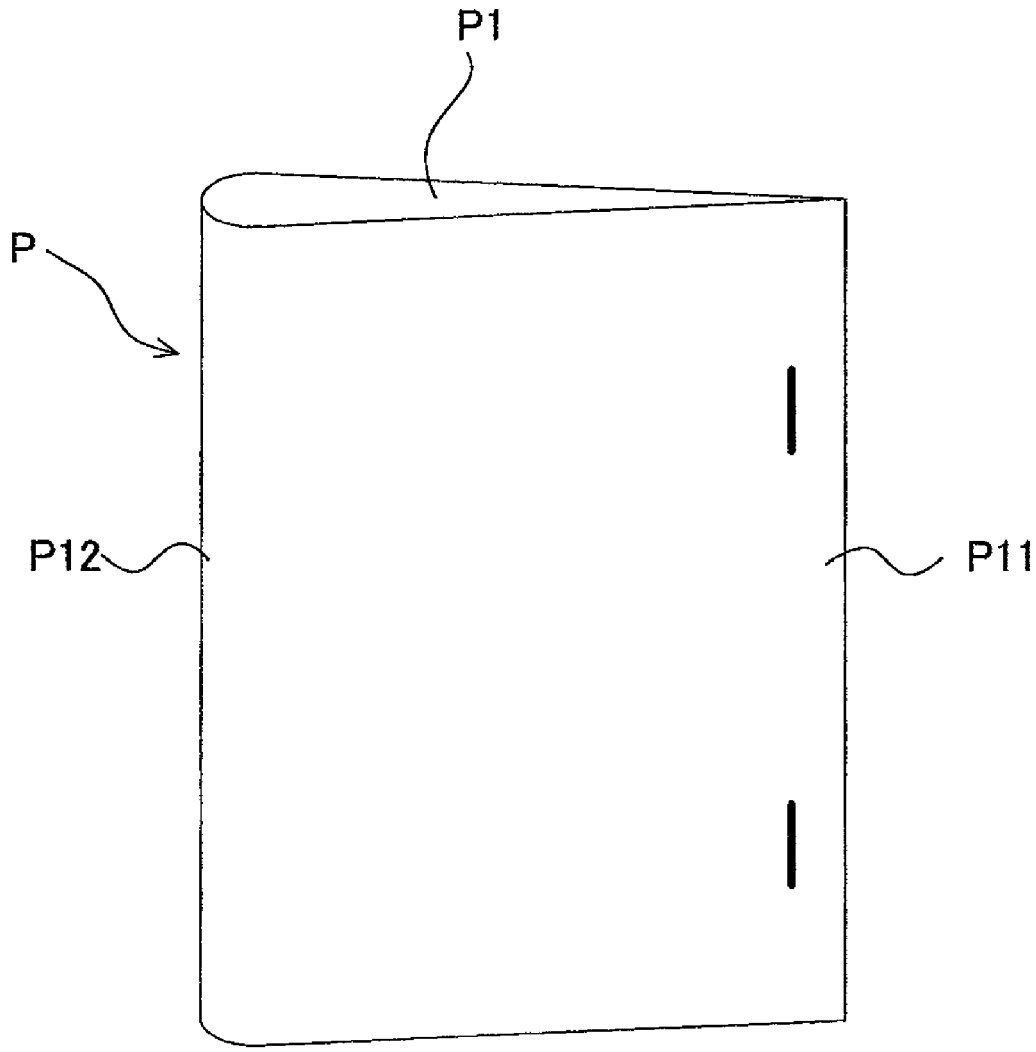
FIG. 6 is an illustrative view showing a state where the paper is center-folded (pouch-bound) by the image forming apparatus.
Figure 7:
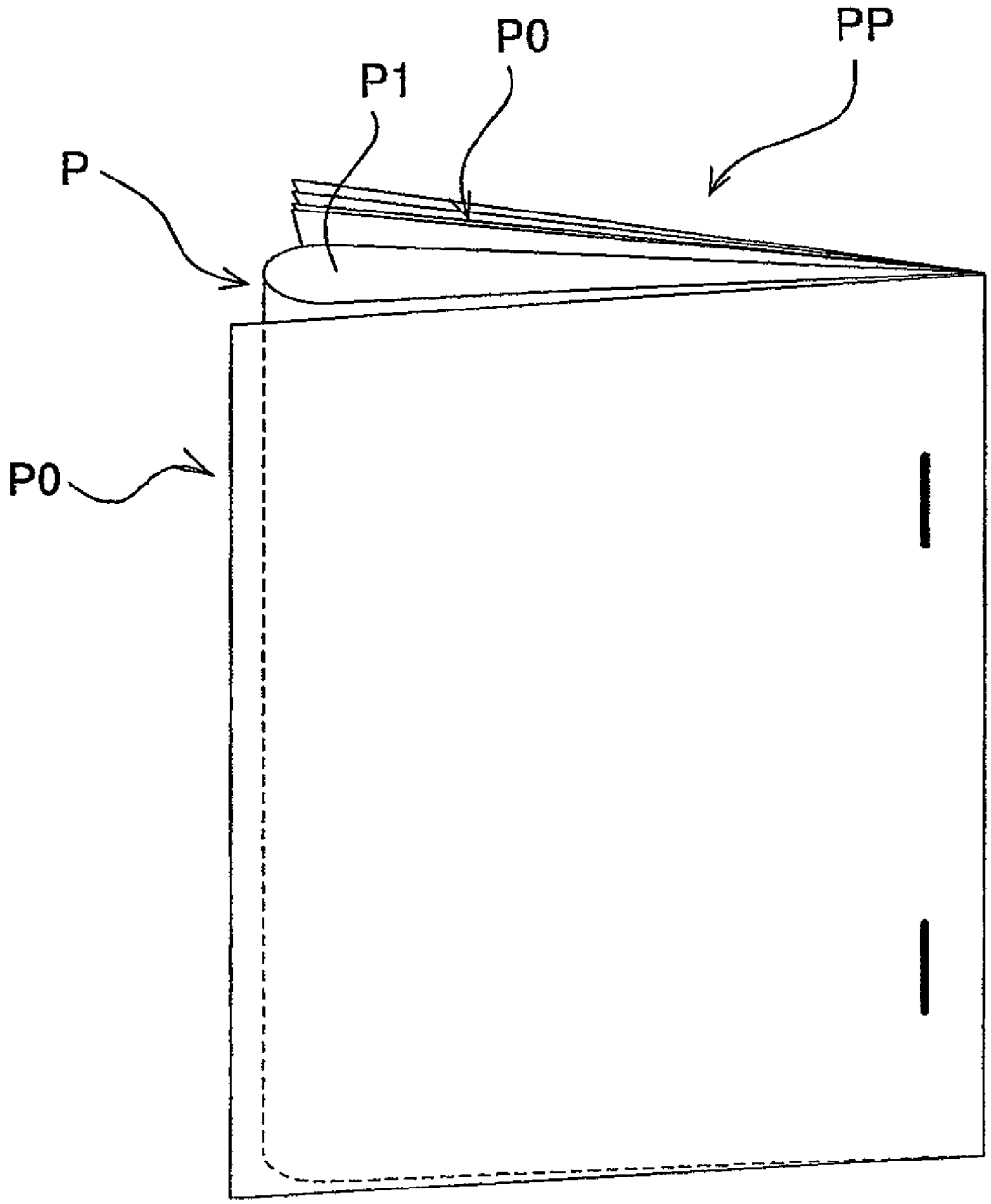
FIG. 7 is an illustrative view showing one example where the center folded paper is pouch-bound with other paper in the image forming apparatus.

FIG. 6 is an illustrative view showing a state where the paper is center-folded (pouch-bound) by the image forming apparatus of the present embodiment. FIG. 7 is an illustrative view showing one example where the center-folded paper is pouch-bound with other paper in the same image forming apparatus.

In image forming apparatus 1A, important information such as confidential information and the like is recorded on the interior side P1 of a folded sheet of paper P as shown in FIG. 6. Then, the end P11 of paper P is stapled (bound) by finisher 1C, whereby it is possible to prevent leakage of the information recorded on interior side P1 of paper P.

In this case, to see the image information recorded on interior side P1 of pouch-bound paper P, it is possible to view the image information by cutting the pouch-bound paper P open along the fold (ridge) P12 of paper P. For example, as shown in FIG. 7, when a pouch-folded sheet of paper P is bound with unfolded sheets of paper P0, if A4 sized paper is used as paper P0, A3 sized paper should be used for the pouch-bound paper P. Since when a sheet of A3 sized paper P is pouch-bound, the folded sheet of paper P is sized to A4 so its size agrees with the other A4-sized sheets of paper P0, hence it is possible to use it without uneasy feeling.

Now, image forming for paper P to be pouch-bound by image forming apparatus 1A will be described.

Figure 8:
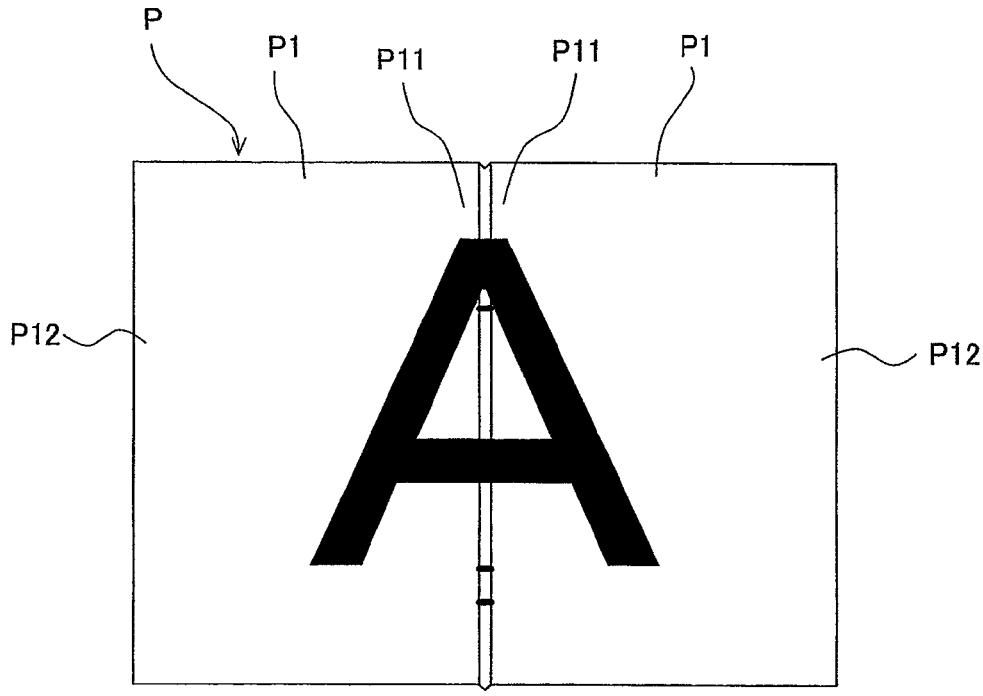
FIG. 8 is an illustrative view showing the arrangement of image data in a state where the paper that has been pouch-bound in the image forming apparatus is cut open along its fold.
Figure 9:
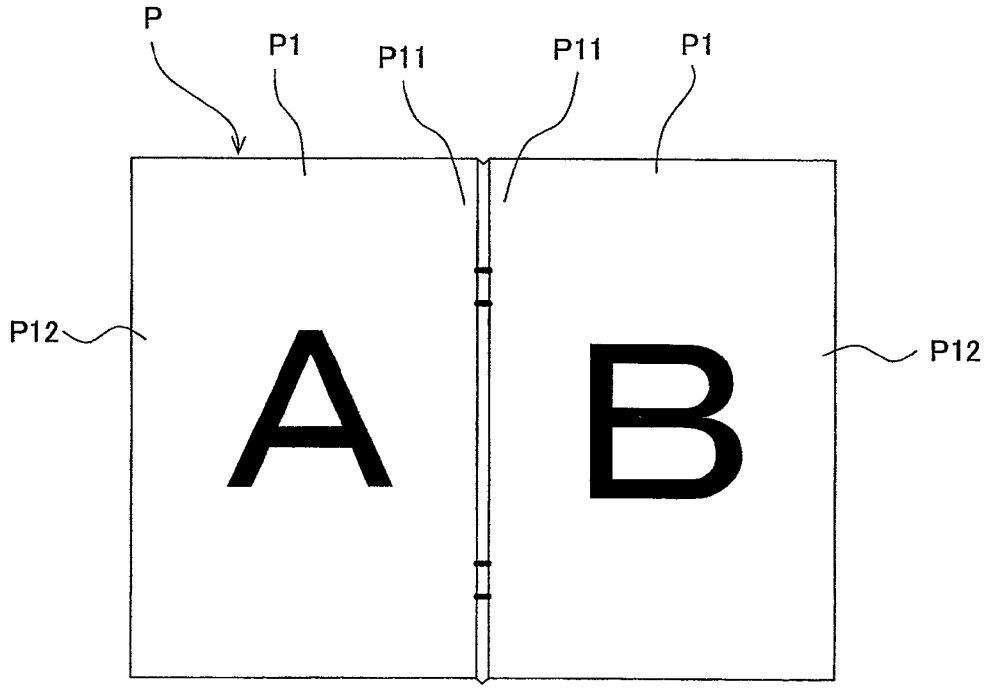
FIG. 9 is an illustrative view showing a state where images are formed on an A3 sheet in a 2 in 1 layout by the image forming apparatus.

FIG. 8 is an illustrative view showing the layout of images in a state where the paper that has been pouch-bound by the image forming apparatus is cut open along the fold. FIG. 9 is an illustrative view showing a state where images are formed on an A3 sheet in a 2 in 1 layout by the same image forming apparatus.

An image for pouch-binding to be formed on the interior side P1 of paper P that is pouch-bound by image forming apparatus 1A is edited such that, as one example, a desired confidential image [A] will be completed when the paper P that has been pouch-bound at its edges P11 and P11, is cut open along a fold P12, as shown in FIG. 8. That is, the image for pouch-binding (FIG. 14) to form the desired confidential image [A] is constituted by laying out the first and second halves of the confidential image [A] that is halved along the center line with respect to the direction of folding, to opposite pages that face each other when folded.

As another example, an image for pouch-binding to be formed on the interior side P1 of paper P that is pouch-bound is edited such that two pages of a desired confidential image [A B] are formed in a so-called 2 in 1 layout when the paper P that has been pouch-bound at its edges P11 and P11, is cut open along fold line P12, as shown in FIG. 9. That is, the image for pouch-binding to form the desired confidential image [A B] is given as [B A] that is formed by laying out the halves of the confidential image [A B] that is halved along the center line with respect to the direction of folding, to the opposite pages that face each other when folded.

According to image forming apparatus 1A with this arrangement, since, for example, the layout of the aforementioned confidential image [A B] is edited and given as [B A] on pouch-bound interior side P1, it is difficult to grasp the confidential image [A B] from the layout-edited image [B A] either in the state where the sheet is pouch-bound or in the state where the sheet is left unstapled. Hence it is possible to improve security and also discloses the confidential image in a simple manner by cutting fold P12 open when needed.

Further, image forming portion 14 in image forming apparatus 1A has a margin varying function 14*a* (FIG. 4) for changing marginal areas where no image is formed, in interior side P1 of folded paper P whose halves face each other, depending on the stapling position SP (FIG. 10) in paper P to be stapled.

Next, the image forming areas and margins in folded paper P in the present embodiment will be described with reference to the drawings.

Figure 10:
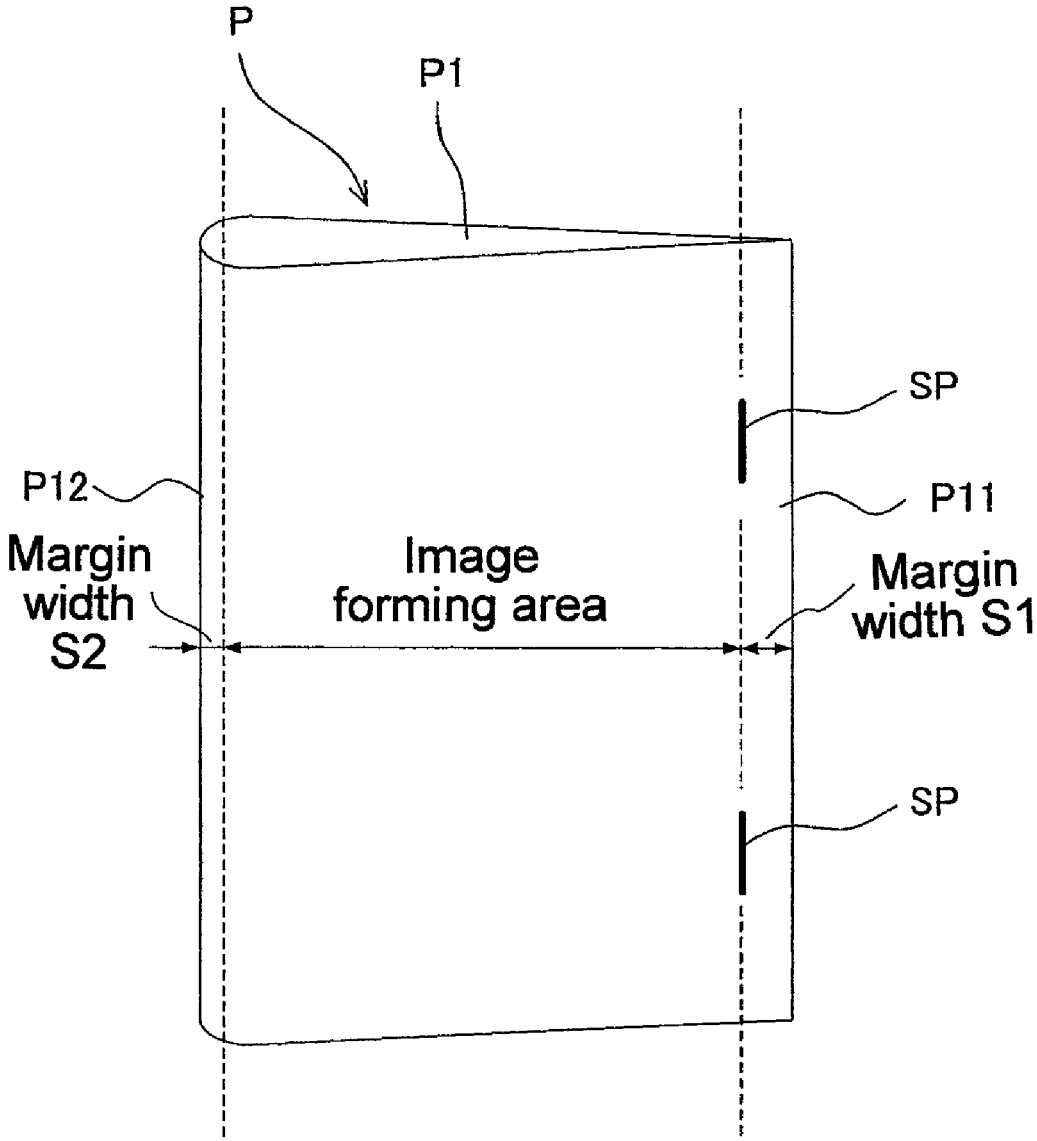
FIG. 10 is an illustrative view showing the arrangement of image forming areas and margins in folded paper in the present embodiment.
Figure 11:
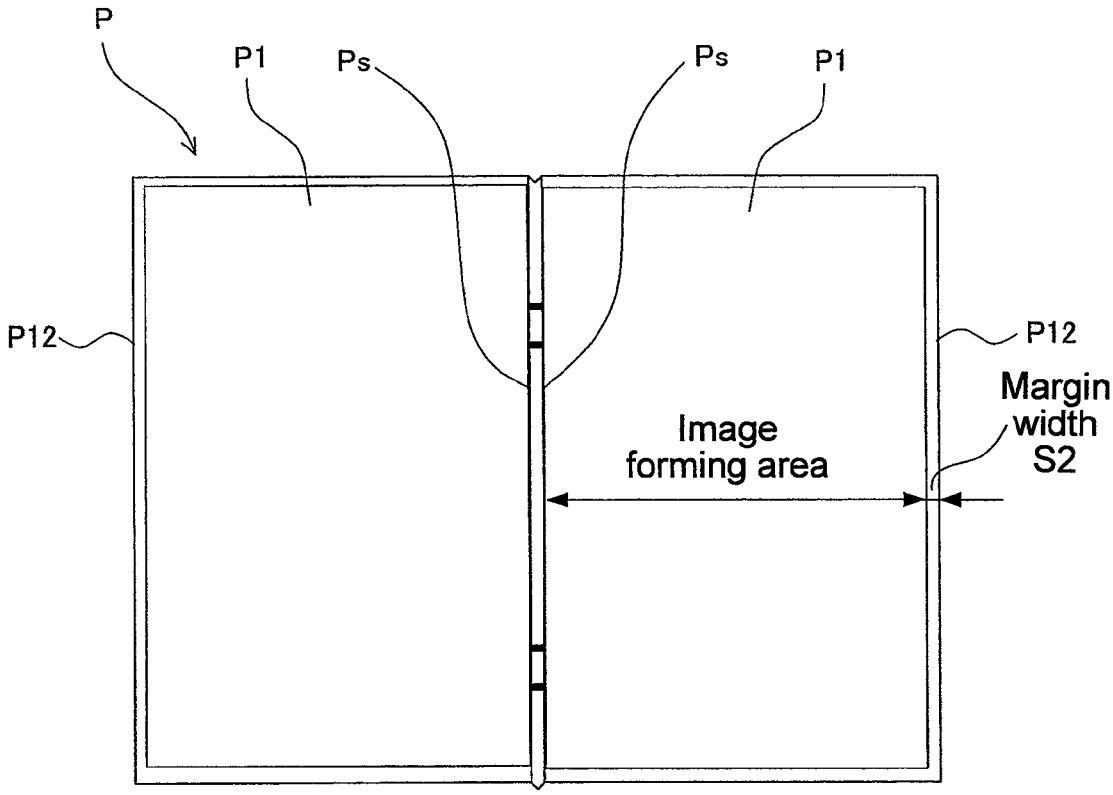
FIG. 11 is an illustrative view showing the arrangement of image forming areas and margins when the folded paper is cut open along its fold.

FIG. 10 is an illustrative view showing the arrangement of image forming areas and margins in folded paper in the present embodiment. FIG. 11 is an illustrative view showing the arrangement of image forming areas and margins when the folded paper is cut open along the fold of the folded paper.

When a spread image [A] in two facing pages as shown in FIG. 8 is formed on paper P, if the image extends toward the edge P11 side beyond stapling position SP (FIG. 10) (the binding area), the whole image [A] cannot be disclosed within the image forming area when paper P is cut open along fold P12 (FIG. 11).

On the other hand, when the margin width S1 in edge P11 (FIG. 10) is greater than the distance from edge P11 to stapling position SP, a gap appears in the formed image, along the joint Ps between two facing pages (FIG. 11), due to deviation of stapling position SP from margin S1, resulting in an awkward image.

To deal with this, image forming portion 14 of the present embodiment is provided with margin varying function 14*a*, so that it is possible to adjust the range of margin width S2 (FIGS. 10 and 11) from folding edge P12 so as to make stapling position SP agree with margin width S1 and joint Ps agree with the edges of image forming areas, to thereby create a good-looking spread image.

Next, an arrangement of images to be formed for a sheaf of paper PP (FIG. 12), including pouch-bound paper P, bound by image forming apparatus 1A will be described.

Figure 12:
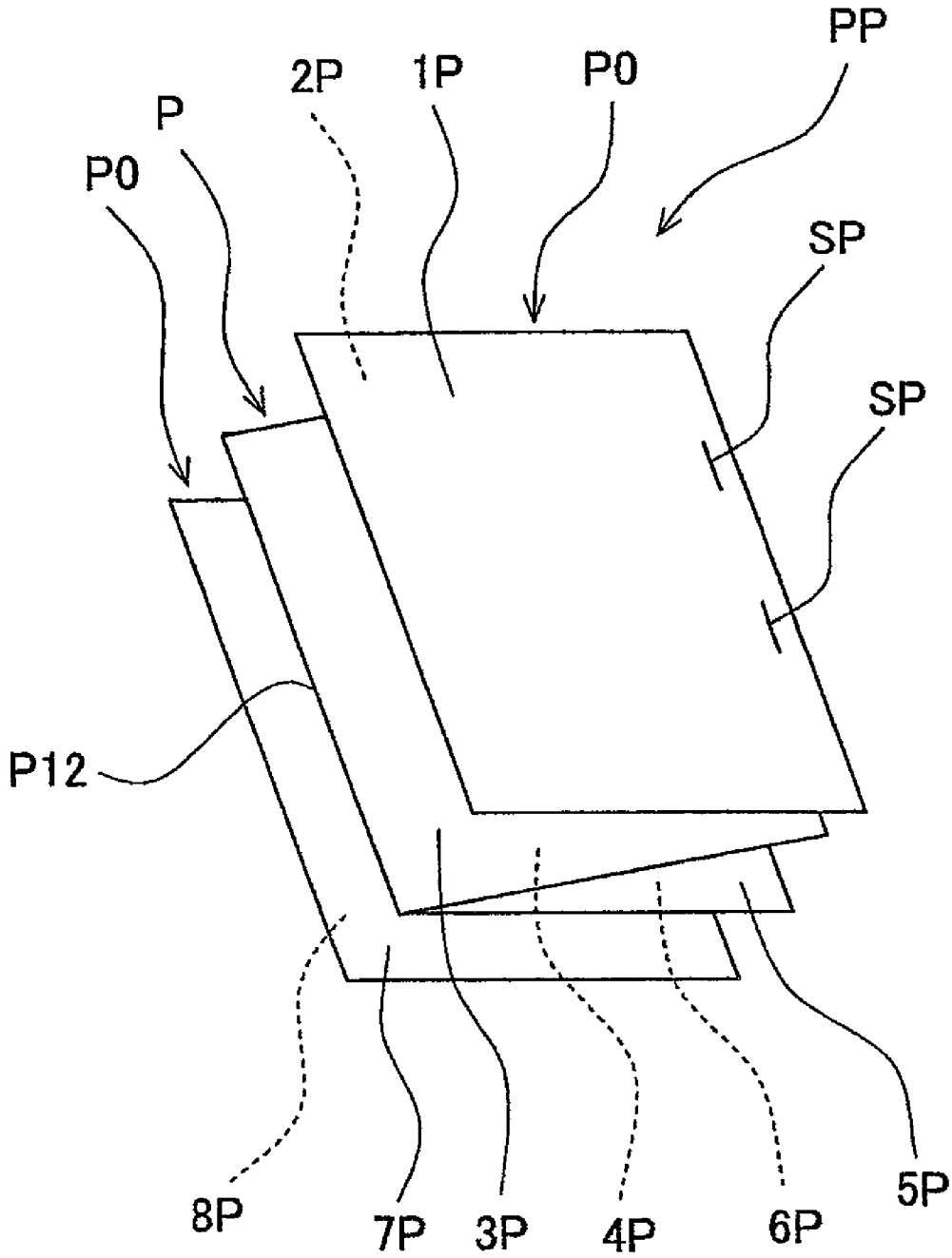
FIG. 12 is an illustrative view showing an arrangement of images for a sheaf of paper including the pouch-bound paper shown in FIG. 7.
Figure 13A:
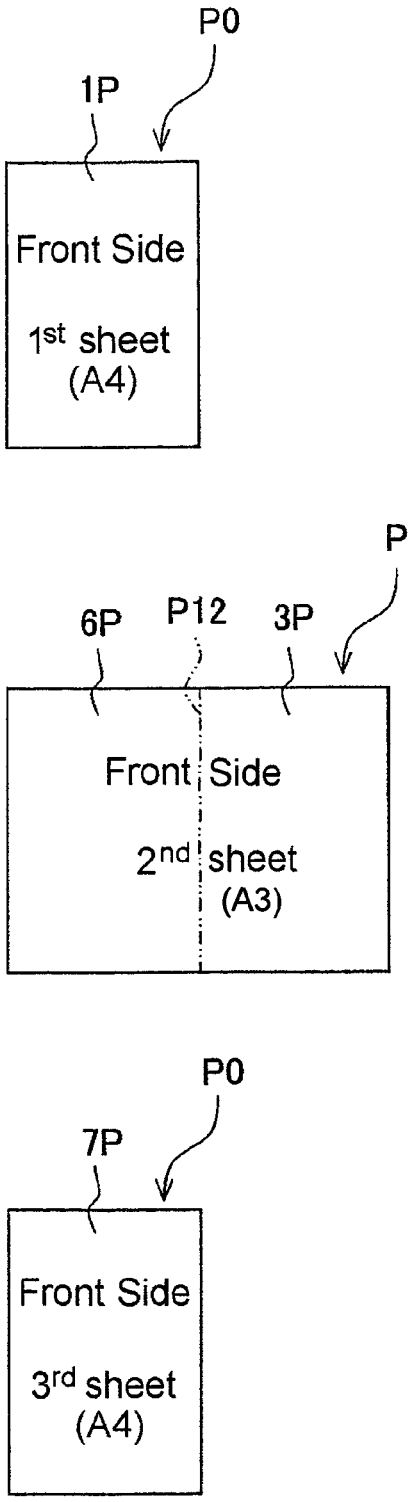
FIG. 13A is an illustrative view showing the page allocation on the front side of individual sheets to be bound.
Figure 13B:
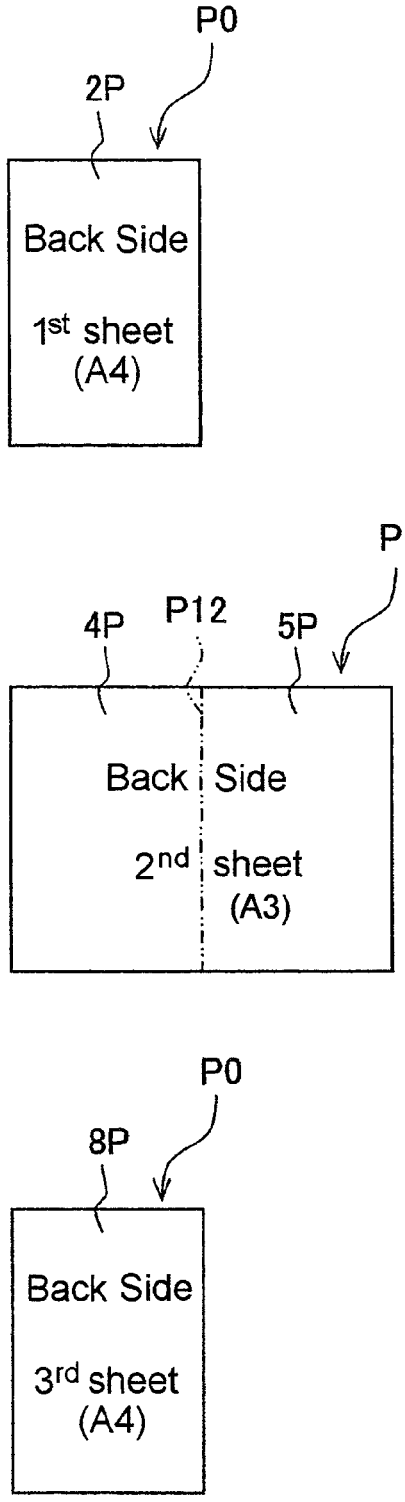
FIG. 13B is an illustrative view showing the page allocation of the back side of individual sheets to be bound.
Figure 14A:
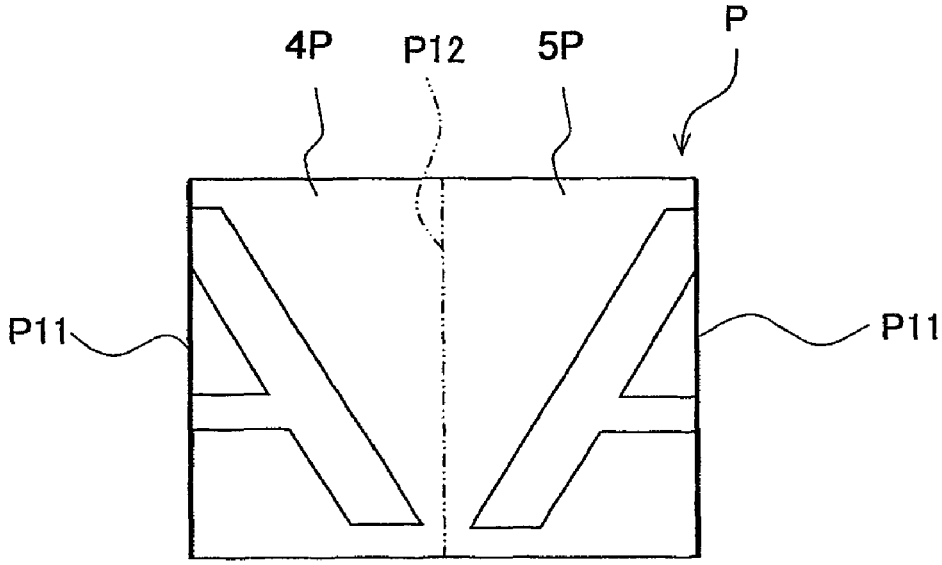
FIG. 14A is an illustrative view showing an image layout on the paper to be pouch-bound.
Figure 14B:
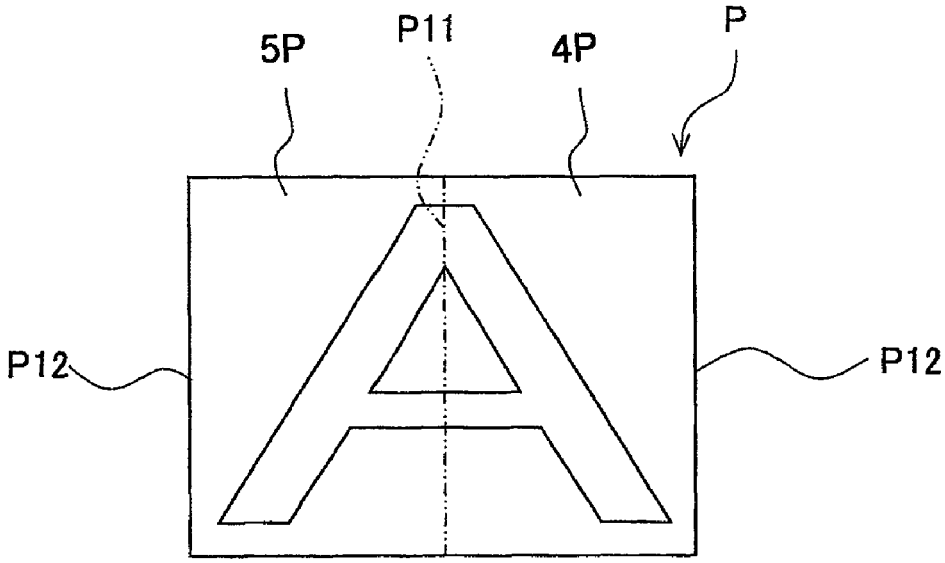
FIG. 14B is an illustrative view showing an image layout when the pouch-bound paper has been cut open.

FIG. 12 is an illustrative view showing an arrangement of images for a sheaf of paper including the pouch-bound paper shown in FIG. 7. FIG. 13A is an illustrative view showing the page allocation of the front side of individual sheets to be bound. FIG. 13B is an illustrative view showing the page allocation of the back side of individual sheets to be bound. FIG. 14A is an illustrative view showing the image layout on the paper to be pouch-bound. FIG. 14B is an illustrative view showing the image layout when the pouch-bound paper has been cut open.

The bound sheaf of paper PP including pouch-bound paper P, produced by image forming apparatus 1A is composed of bound sheets of paper P and P0, as shown in FIG. 12. Reference numerals 1P to 8P added to paper P and P0 represent the page numbers of associated pages.

When images are arranged in pouch-bound paper P in a 2 in 1 layout, allocation of pages for paper P and P0 in sheaf of paper PP is given as shown in FIGS. 13A and 13B. That is, the pouch-bound paper P is printed on both sides. The front side to be the exterior pages of the pouch is allotted with 3P and 6P while the back side to be the interior pages of the pouch is allotted with 4P and 5P. With this allocation, it is understood that the layout of images will change when the pouch-bound sheet is cut open along the fold (ridge) P12.

Specifically, the images for pouch-binding, formed on the interior side of pouch-bound paper P is constituted by swapping the first and second halves of the desired spread image [A] that is halved along the center line with respect to the direction of folding, to opposite pages that face each other when folded.

As a result, image processor 57 generates the image data for pouch-binding of which the layout of the input confidential image [A] has been edited as above when a confidential image printing command is given, and outputs the printing image data (image data for pouch-binding) to image forming portion 14.

When the pouch-bound paper P is cut open along the fold (ridge) P12 of the pouch, the desired confidential image [A] is disclosed with edges P11 of paper P bound, as shown in FIG. 14B.

Since the layout of the images for pouch-binding formed on the interior pages (4P, 5P) of pouch-bound paper P is edited in the above way, it is difficult to grasp the confidential image either in the state where the sheet is pouch-bound or in the state where the sheet is left unstapled, hence the confidential image will not be disclosed until fold P12 is cut open. That is, it is possible to prevent leakage of confidential information.

As a result, according to the present embodiment, when a confidential image printing command is given, especially when confidential image printing is carried out by remote control instructions, it is possible to prevent leakage of important image information and improve security.

Further, according to the present embodiment, since margin varying function 14*a* for changing marginal areas is provided for image forming portion 14, it is possible to adjust the margins so that no image will be formed in the margins along the paper edges where stapling is done. Accordingly, it is possible in performing a pouch-binding operation to prevent part of image information from being bound and hidden and lay out the image information in the optimal position when pouch-bound paper P is cut open.

Having described the preferred embodiments of the present invention, the present invention should not be limited to the above-described embodiment, and various changes can be made within the scope of claims. That is, any embodied mode obtained by combination of technical means disclosed by the above embodiment modes should be included in the technical art of the present invention.

For example, in the above embodiment, the present invention is applied to a monochrome image forming apparatus, however the present invention should not be limited to the image forming apparatuses and copiers having the above configuration. That is, the present invention can also be applied to a color image forming apparatus (multifunctional machine, printer, etc.) as long as it includes an image processor that can convert image information into image data.

What is claimed is:

1. An image forming apparatus, comprising:

an image processor for outputting input image information in the form of image data for forming images;

an image forming portion for forming images on recording paper based on the image data output from the image processor;

a folding mechanism for folding the recording paper with images formed by the image forming portion when the input image information is confidential image information; and a stapling mechanism for pouch binding the recording paper by binding the recording paper folded by the folding mechanism, at an end part opposite a side of the fold when the input image information is confidential image information, wherein when the input image information is confidential image information, the image processor outputs pouch-binding image data for a pouch-bound image to be formed on facing pages of the recording paper that is folded by the folding mechanism, by editing the layout of the confidential image, and wherein the pouch-bound image is given by swapping the positions of the left and right halves of the confidential image with respect to the fold.

2. The image forming apparatus according to claim 1, wherein the images to be disclosed on the facing pages of the folded recording paper by cutting open the folded recording paper along the fold complete the confidential image.

3. The image forming apparatus according to claim 1, wherein when the recording paper is to be stapled by the stapling mechanism, the image forming portion changes marginal areas where the pouch-bound image is not formed, in the recording paper, depending on the stapling position in the recording paper.

4. The image forming apparatus according to claim 1, wherein the image forming portion performs image forming so that the confidential image will be arranged in suitable position in the recording paper when the folded recording paper is cut open along the fold to present the confidential image substantially as the confidential image appeared prior to editing.

5. The image forming apparatus according to claim 1, wherein the image forming portion allocates two pages of image information on a sheet of recording paper to be folded.

* * * * *